US006609773B1

(12) United States Patent
Steadman

(10) Patent No.: US 6,609,773 B1
(45) Date of Patent: Aug. 26, 2003

(54) STORAGE APPARATUS

(75) Inventor: William David Steadman, Port Saint Lucie, FL (US)

(73) Assignee: William D. Steadman, Port Saint Lucie, FL (US)

( * ) Notice: Subject to any disclaimer, the term of this patent is extended or adjusted under 35 U.S.C. 154(b) by 0 days.

(21) Appl. No.: 09/806,859

(22) PCT Filed: Oct. 5, 1999

(86) PCT No.: PCT/GB99/03292

§ 371 (c)(1),
(2), (4) Date: Apr. 5, 2001

(87) PCT Pub. No.: WO00/21411

PCT Pub. Date: Apr. 20, 2000

Related U.S. Application Data

(60) Provisional application No. 60/104,246, filed on Oct. 14, 1998.

(51) Int. Cl.[7] ..... A47B 51/00

(52) U.S. Cl. ..... 312/298; 312/319.5; 312/312; 108/105; 211/1.56; 211/1.57

(58) Field of Search ..... 312/238, 125, 312/135, 249.2, 298, 305, 319.5, 319.6, 319.7, 319.8, 299, 312; 108/20, 105, 141, 149; 248/243, 244; 211/1.52, 1.56, 1.57

(56) References Cited

U.S. PATENT DOCUMENTS 1,676,108 A * 7/1928 Novak ..... 108/106
1,929,677 A * 10/1933 Davis ..... 312/202
3,252,581 A * 5/1966 Jenkins et al. ..... 198/367
3,679,065 A 7/1972 Aurtemma
3,694,046 A 9/1972 Gehrmann
3,933,400 A * 1/1976 Helgeson
4,724,774 A * 2/1988 Wiedemar et al. ..... 109/48
5,586,816 A * 12/1996 Geiss, II ..... 312/301

FOREIGN PATENT DOCUMENTS

| | | | | |
|---|---|---|---|---|
| CA | 456484 | * | 5/1949 | ..... 312/305 |
| GB | 877328 | | 9/1961 | |
| GB | 2185384 | | 7/1987 | |

* cited by examiner

*Primary Examiner*—Janet M. Wilkens
(74) *Attorney, Agent, or Firm*—Watts, Hoffmann, Fisher & Heinke Co., L.P.A.

(57) ABSTRACT

A storage apparatus (10) comprising a plurality of first storage compartments (26) which are rotatably mounted around a substantially vertical shaft (14). The apparatus (10) being arranged such that the first compartments (26) are usually in a raised position, and a selective one of the first compartments (26) can be moved down the shaft (14) to bring the respective first compartment (26) to an accessible height. The apparatus (10) may also comprise one or more lower second storage compartments (16) which may define a space (18) into which the respective first compartment (26) can be slid.

28 Claims, 8 Drawing Sheets

STORAGE APPARATUS

This application claims the benefit of provisional application Ser. No. 60/104,246 filed Oct. 14, 1998.

This invention concerns improvements in or relating to storage apparatus.

Raised storage arrangements as used for example in kitchens, are generally not particularly efficient nor easy to use. Such arrangements such as for example kitchen cupboards, are often not at an easy height for people to use. Consequently, people may need to stand on chairs, stepladders and the like to reach them. Also, the space above such storage arrangements is often under used and/or even more difficult to use due to access difficulties.

According to the present invention there is provided storage apparatus, the apparatus comprising a frame arrangement and a plurality of first storage compartments, the first compartments being rotatably mounted on the frame about a substantially vertical axis, with the apparatus being arranged such that a selective one of the first compartments can be moved along said axis to bring said compartment to an accessible height.

The apparatus is preferably arranged such that the first compartments are locatable in a raised rest position, and a selective one thereof can be lowered to a lower accessible height. The apparatus may also comprise one or more lower second compartments, and desirably which define a space to receive part or all of a one of the first compartments when fully lowered. The space may be defined between adjacent second compartments.

The or each second compartment may be rotatably mounted on the frame. The or each second compartment may be interchangeable with a first compartment such that a second compartment is movable to the raised rest position. In an alternative embodiment a single second compartment is provided which extends wholly around the frame axis except for a segment which defines the space which may receive a first compartment.

The top of the second compartments and perhaps also the first compartments when fully lowered, preferably provide a work surface.

The apparatus may be arranged such that a first compartment can only be lowered when in a particular circumferential position on the axis.

An upper ring may be provided around the axis to rotatably support the first compartments, and a gap may be provided in the ring to correspond to said particular circumferential position. A lift member may be provided which is locatable in the gap to support a first compartment to be lowered, and is selectively vertically movable.

The lift member is preferably arranged to substantially close the ring when said member is in an upper position.

A support bracket may be provided on each first compartment, said brackets being slidably engageable with the ring and lift member.

A lower ring maybe provided to rotatably support the or each second compartment, and a gap may be provided in the ring to correspond to said space.

The apparatus may comprise a central shaft which mounts the upper ring, and around which shaft the first compartments are rotatable. The second compartments may be arranged around the shaft with a radial space to receive the first compartments.

Lifting means may be provided for raising and lowering the lift member, and said means may comprise a band extendible from the lift member to be selectively feedable in and out of the shaft. The shaft may be provided with a groove or other formation along which the lift member is slidably movable.

Alternatively a rotatable threaded bar may be provided which substantially non-rotatably mounts a link member connected to the lift member, such that rotation of the threaded bar causes raising and lowering of the lift member.

Means may be provided for rotating the first compartments and/or the or each second compartments relative to the shaft, and said means may comprise one or more drivable wheels extending through the wall of the shaft to engage with the compartments. A motor may be provided for driving the or each wheel, and a plurality of wheels may be provided which are connected to the motor by belts.

Control means may be provided to enable a person to operate the apparatus.

A cover may be provided extendible over the first compartments. The cover is preferably open bottomed.

A closure may be provided extending over substantially all of the apparatus. The closure may comprise one or more openable parts, which may comprise doors, to provide access to the apparatus.

The apparatus may be arranged such that when the closure is fully closed the apparatus moves to a particular orientation if not already in said orientation, and said orientation may comprise all of the first compartments in the raised rest position. The control means may only be accessible when at least one of the openable parts is open.

In one embodiment ground engaging wheels are provided on the frame arrangement to permit ready movement of the apparatus.

Embodiments of the present invention will now be described by way of example only and with reference to the accompanying drawings, in which.

Figure 1:
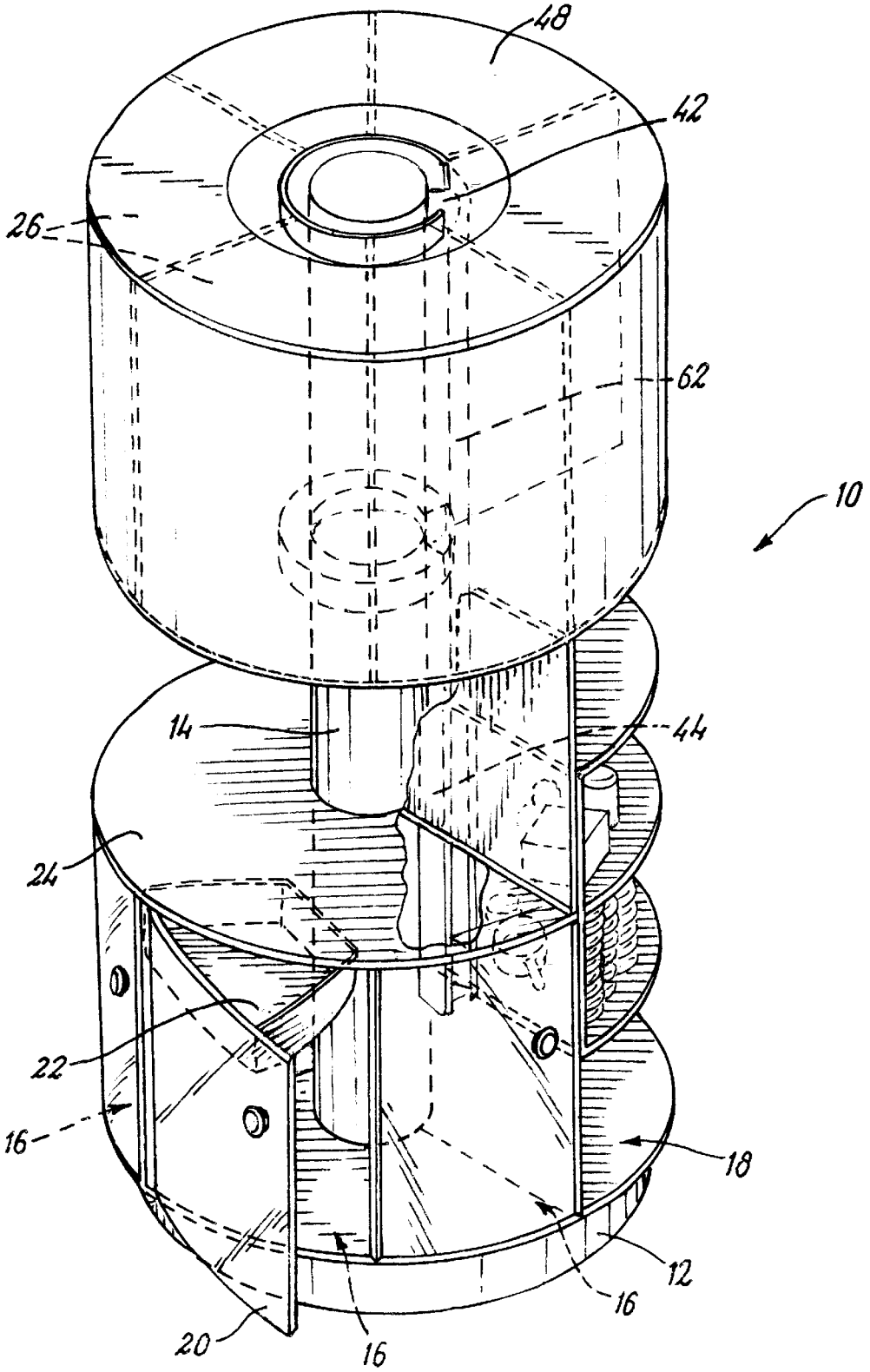
FIG. 1 is diagrammatic perspective view of a first storage apparatus according to the present invention.
Figure 2:
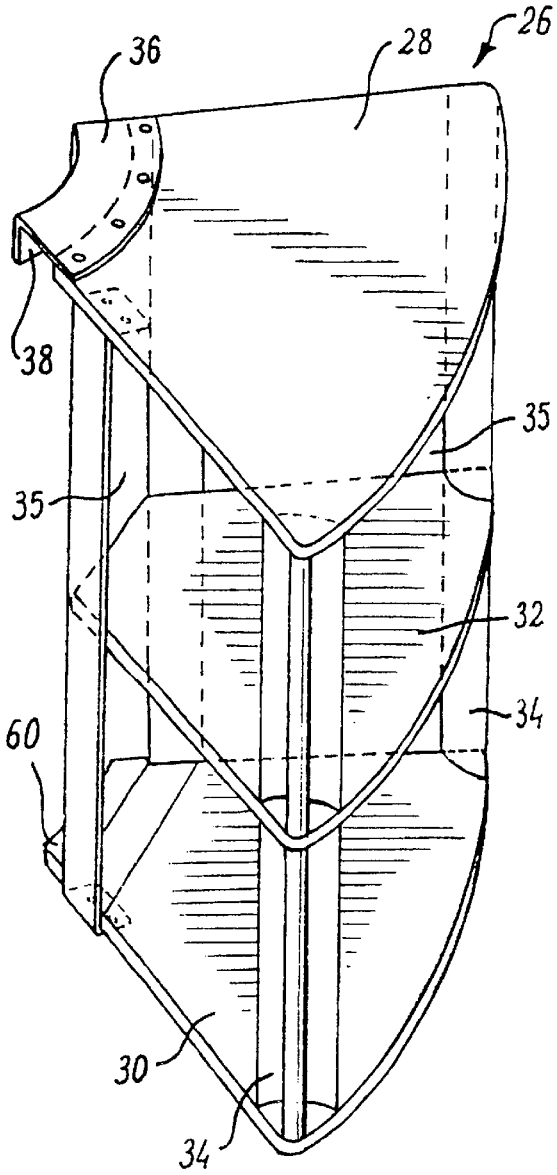
FIG. 2 is a diagrammatic perspective view of part of the apparatus of FIG. 1.
Figure 5:
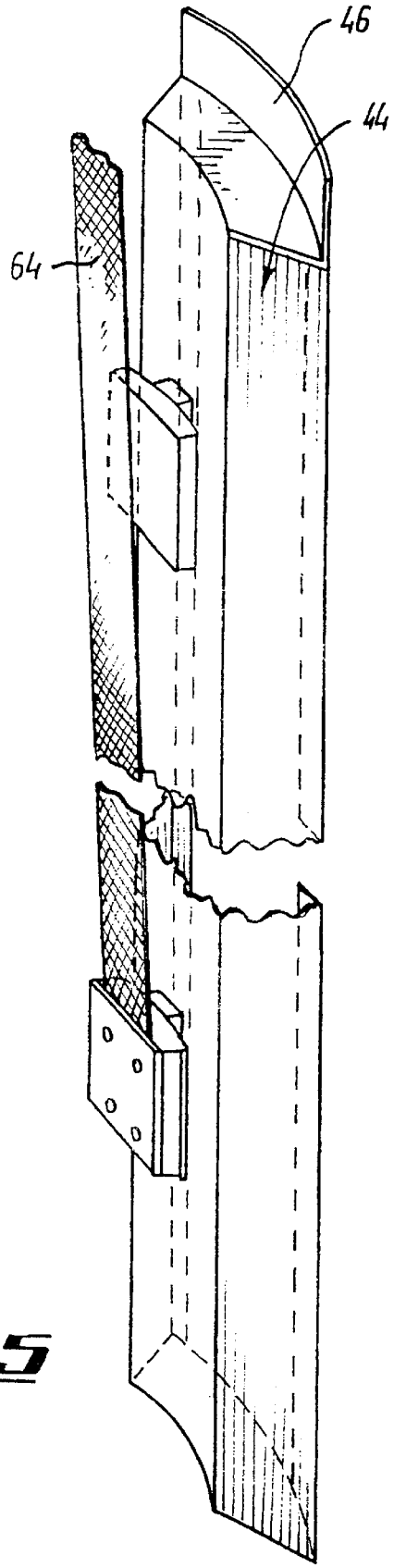
FIG. 5 is a diagrammatic perspective view of a yet further part of the apparatus of FIG. 1.

FIGS. 1 to 5 of The drawings show a storage arrangement 10 suitable for use for instance as an island kitchen cupboard arrangement. The arrangement 10 comprises a plinth 12 from which an upstanding shaft 14 extends. Five lower cupboards 16 are provided around the shaft 14 with a space 18 left on the plinth 12 to correspond to the other cupboards 16. The cupboards 16 have arcuate doors 20 with drawers 22 mounted therebehind to be accessible when the doors 20 are open. The top of the cupboards 16 is in the form of a worksurface 24.

The arrangement 10 also comprises six upper cupboards 26. In a rest condition each of the cupboards 26 rests around the shaft 14 spaced above the surface 24. A selective one of the cupboards 26 can be moved into the space 18 as is shown in FIG. 1. The cupboards 26 comprise upper and lower surfaces 28,30 and a shelf 32 spaced therebetween. The surfaces 28,30 and shelf 32 are mounted between four upright members 34. Rear and side panels 35 are provided extending between the respective members 34. A mounting bracket 36 is provided on the inner upper edge of the upper surface 28 extending radially inwardly from the cupboard 28 and comprising a downturned lip 38.

A ring 40 of upwardly open channel section is provided around the top of the shaft 14. The lips 38 of the brackets 36 slidingly locate in the ring 40. An opening 42 is provided in the ring 40 of a slighter greater size than each of the brackets 36. In an upper condition a lifting member 44 provides an inwardly facing shaped section part 46 to substantially close the opening 42.

Figure 3:
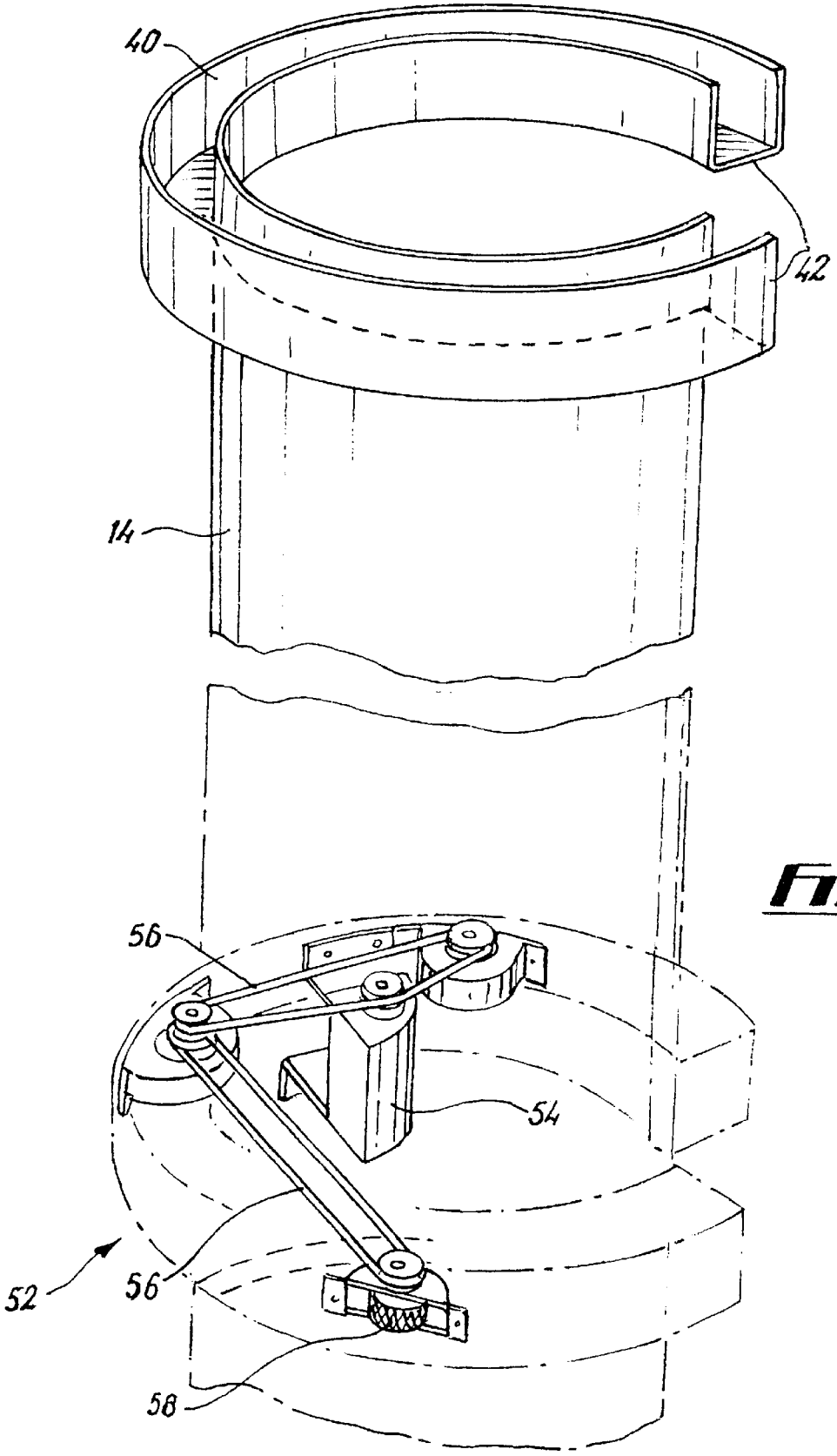
FIG. 3 is a diagrammatic perspective view of a further part of the apparatus of FIG. 1.
Figure 4:
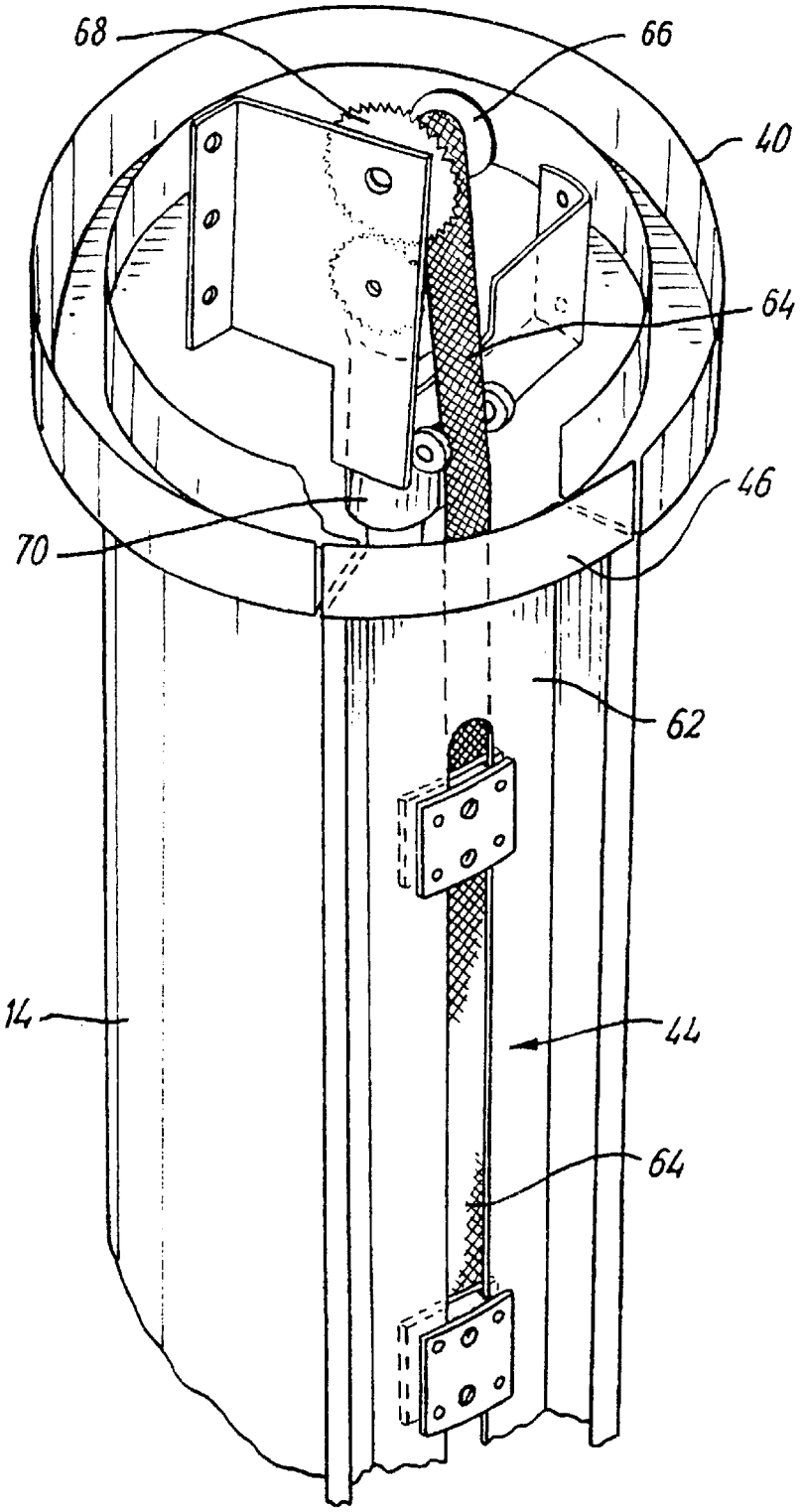
FIG. 4 is a diagrammatic perspective view of a still further part of the apparatus of FIG. 1.

The upper cupboards 26 are closed within an open bottomed cover 48. The cupboards 26 are rotatable around the shaft 14, and FIG. 3 shows a drive arrangement 52 to achieve this. The arrangement 52 is mounted substantially within the shaft 14 towards the lower end of the cupboards 26 when in a raised condition. The arrangement 52 comprises a motor 54 connected by belts 56 to three drive wheels 58 which extend through the surface of the shaft 14 to be engageable with nylon faced rubbing blocks 60 provided on an inner face of the lower surfaces 30 of the cupboards 26.

A slot 62 is provided running down the shaft 14, and the lifting member 44 slidably locates in the slot 62 to substantially close same. A band 64 is mounted to the inside face of the lifting member 44 and extends to the top of the shaft 14 where it can be fed on or off of a roller 66 to raise or lower the lifting member 44 and hence upper cupboard 26 located thereon. The roller 66 is driven through gearing 68 by a motor 70 located within the shaft 14.

The arrangement 10 can be used in the following way. With all the cupboards 26 in a raised position these can be rotated by virtue of the arrangement 52 such that a required cupboard 26 is above the space 18. The respective upper cupboard 26 can then be lowered by virtue of the band 64 being fed off the roller 66 by actuation of the motor 70. The upper cupboard 26 can be lowered fully into the space 18 or stopped at an appropriate convenient height.

There is thus described a storage arrangement which provides for very efficient and convenient storage. The upper cupboards can be arranged to reach substantially up to the ceiling thereby making full use of this space, but allowing the cupboards to be accessed from a required height. The arrangement also provides a useful working surface and a number of lower cupboards. The apparatus is in most parts of relatively straightforward construction and can thus be inexpensively and robustly manufactured, and can be lightweight. The arrangement can be supplied or at least transported in a flat pack configuration. Provision of the single upper cover provide for weight savings.

Figure 6:
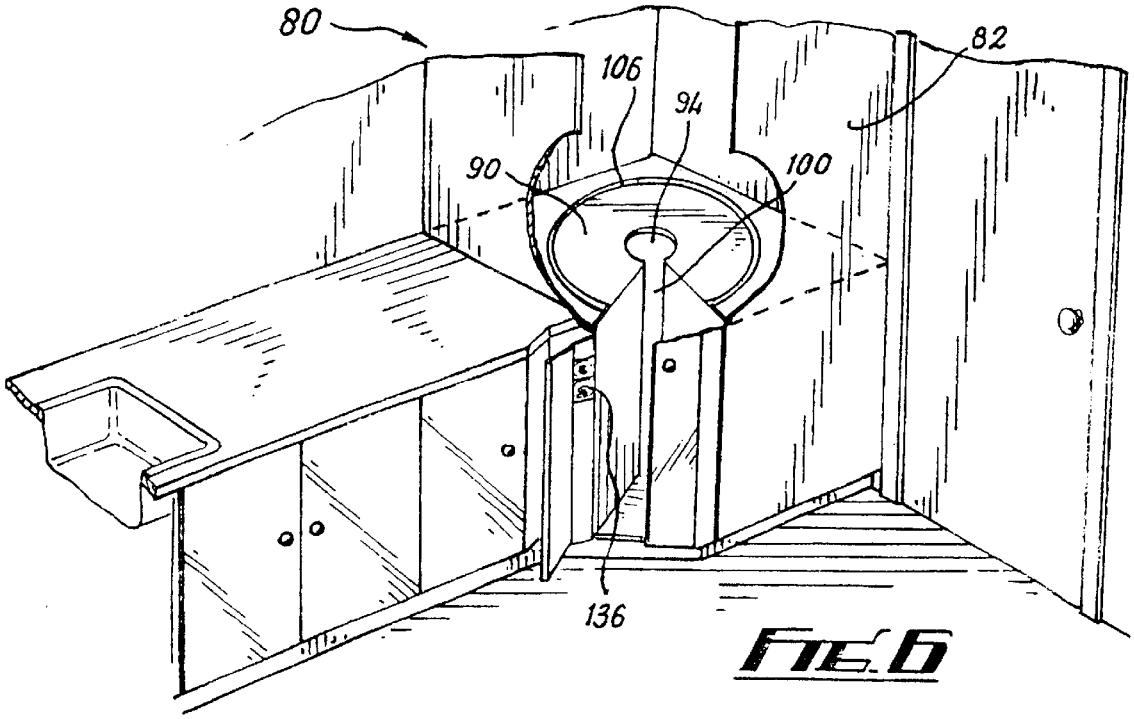
FIG. 6 is a diagrammatic part cut away perspective view of a second storage apparatus according to the invention.
Figure 7:
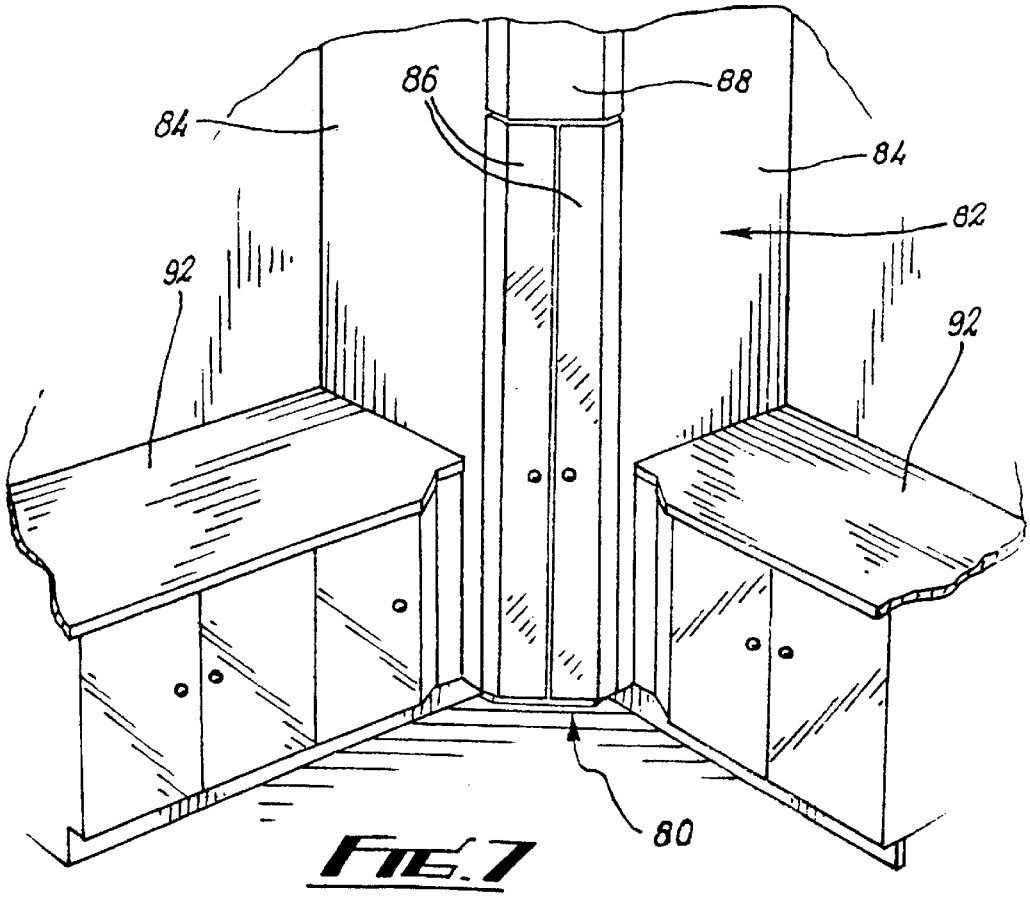
FIG. 7 is a perspective view of the apparatus of FIG. 6 in a closed condition and in a different setting.

FIGS. 6 to 11 of the drawings show a further storage arrangement 80 suitable for use as a corner kitchen cupboard arrangement, and two possible different settings are shown in FIGS. 6 and 7. The arrangement 80 comprises an enclosure 82 defined by side walls 84 and a pair of openable doors 86 which when closed extend across the apex between the side walls 84. A panel 88 is provided extending above the doors 86 in a parallel alignment to the doors 86 when closed.

Figure 8:
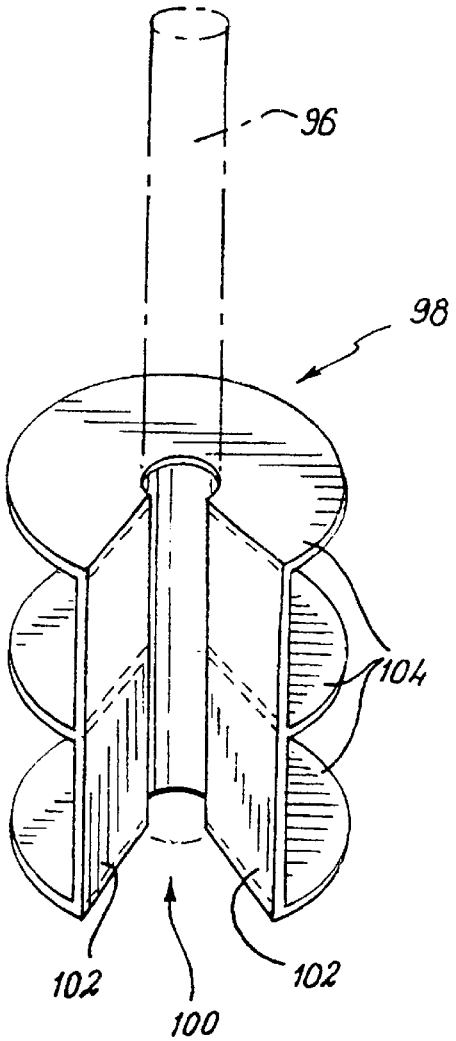
FIG. 8 is a diagrammatic perspective view of part of the apparatus of FIG. 6.

A support surface 90 is provided within the enclosure 82 at a similar height to the surrounding work surfaces 92. A hole 94 is provided through the surface 90 through which a shaft 96 extends which is similar to the shaft 14. A lower cupboard arrangement is provided freely rotatable around the shaft 96. The arrangement may comprise a single unit 98 as shown in FIG. 8 which extends for the majority of a circle around the shaft 96 except for a segment 100 defined by side walls 102. The arrangement 98 comprises three substantially horizontal spaced shelves 14. In an alternative arrangement (not shown) the lower cupboard arrangement may comprise a number of separate members arranged around the shaft 96 so as to leave a segment. The lower cupboard arrangement may be rotatably mounted on a ring 106 which extends around the shaft 96 except in a segment facing the doors 86.

The arrangement 80 also comprises a plurality of upper cupboards (not shown) in a similar arrangement to that described for the arrangement 10. Where the lower arrangement comprises a plurality of different members these may be interchangeable with one of the upper cupboards. In this instance the upper cupboards are smaller than those in the arrangement 10, and are freely rotatable. Not having a drive arrangement allows the shaft 96 to be considerably smaller thereby providing greater storage space.

The arrangement 80 comprises a different lifting arrangement (FIG. 10) for moving the upper cupboards up or down in a similar manner to that described above. The lifting arrangement comprises a threaded bar 108 rotatably extending downwardly from a motor 110, within the shaft 96. An internally threaded sleeve 112 is mounted on the bar 108. An extension 114 from the sleeve 112 extends into a channel 116. The channel 116 is located just within the circumference of the shaft 96 to permit free rotation of cupboards around the shaft 96. The channel 116 is outwardly open and has inwardly turned flanges 118. Three rollers 120 are provided on either side of the extension 114 engageable against the flanges 118.

The extension 114 mounts by an L shaped bracket 121 a part 122 similar to the part 46 described above. The part 122 closes a ring 124 similar to the ring 40. The upper cupboards have a slightly different mounting arrangement in that a mounting bracket 126 (FIG. 11) which is similar to the bracket 36 is provided above a recess 128 such that a smaller amount of the upper cupboard interior is lost to the mounting arrangement. The recess 128 is of a size to just locate the bracket 121.

Figure 9:
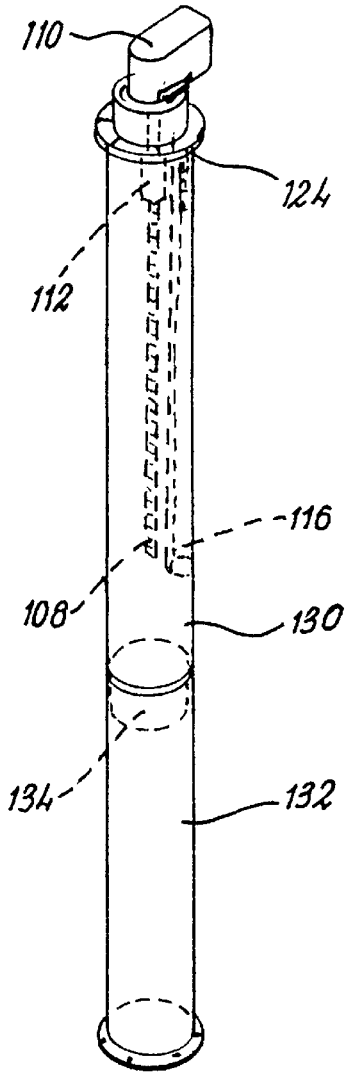
FIG. 9 is a diagrammatic perspective view of a further part of the apparatus of FIG. 6.
Figure 10:
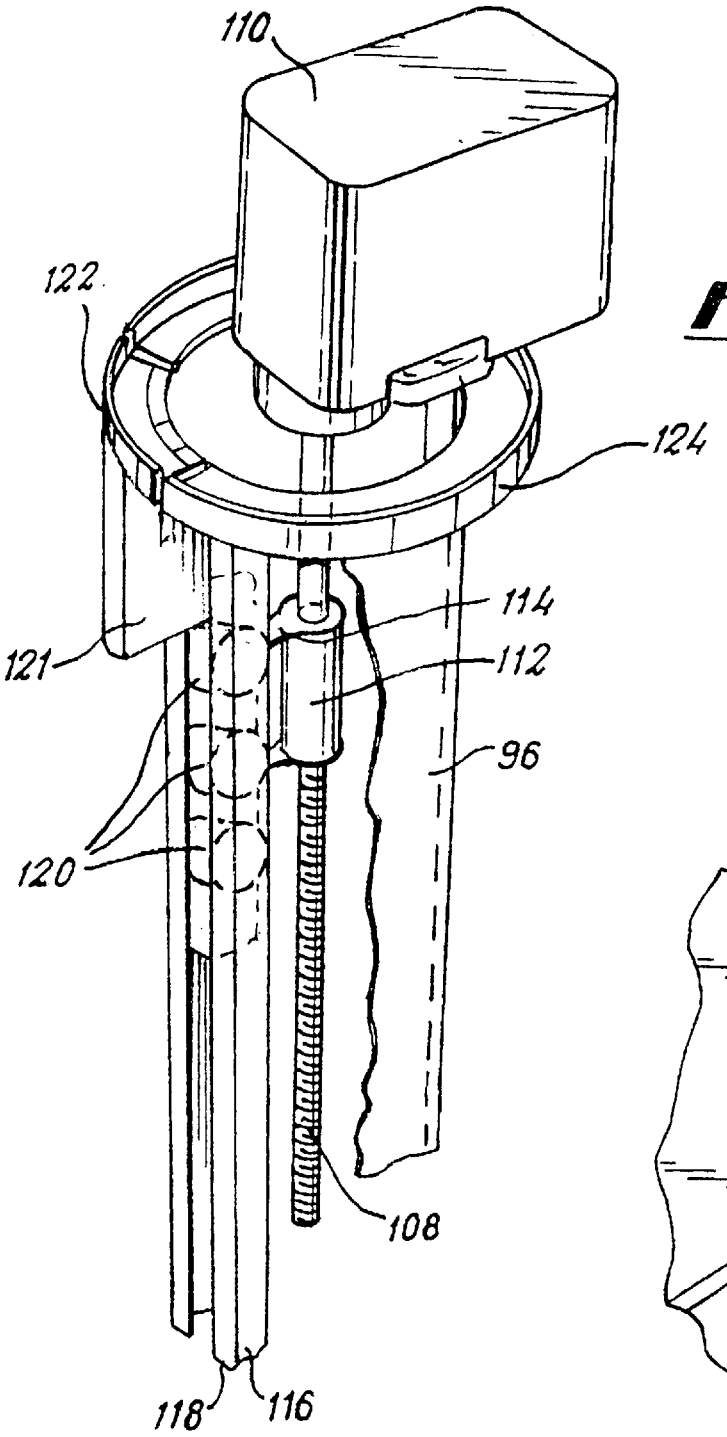
FIG. 10 is a more detailed view of part of the apparatus as shown in FIG. 9.
Figure 11:
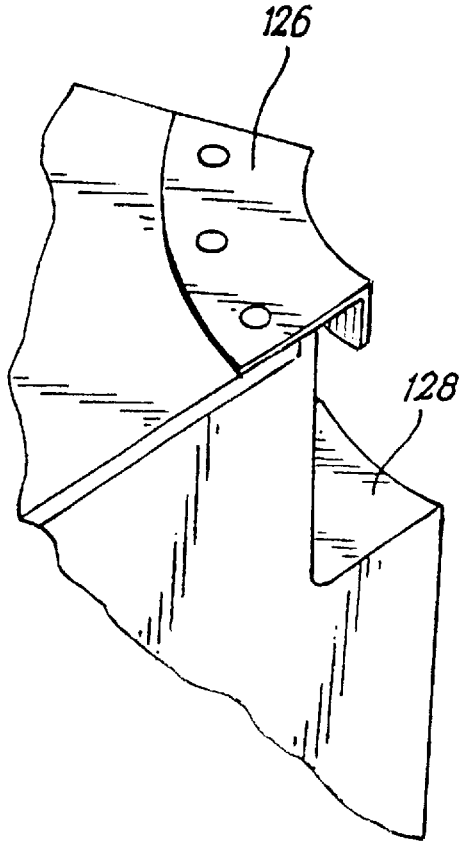
FIG. 11 is a detailed perspective view of a still further part of the apparatus of FIG. 6.

FIG. 9 shows the shaft provided in two parts, with the upper part 130 locating on the lower part 132 by virtue of a downwardly extending projection 134 slidingly engageable in the part 132. The lower cupboard arrangement 98 is rotatable about the part 132. The two part arrangement considerably eases installation and maintenance.

A control arrangement 136 is provided on an inside of one of the doors 86 such that it is only accessible when the doors 86 are open.

In use, the doors 86 will be opened. The lower cupboard arrangement can be rotated so as to provide access to items therein. If an item is required from one of the upper cupboards, these can be freely rotated until the item is accessible. If however the item still cannot be reached, the lower arrangement will be arranged such that the open segment faces the doors 86 as shown in FIG. 6. The upper cupboard arrangement containing the item can then be lowered into the segment using the motor 110 to rotate the bar 118 causing the sleeve 112 and hence upper cupboard to move downwardly. Where the lower cupboard arrangement comprises a plurality of cupboards, these could be rotated such that a selected one faces the doors 86, and this could then be raised into the upper arrangement. The arrangement

80 may be configured such that when the doors 86 are closed, the cupboard in the outwards facing segment will automatically rise upwardly.

There is thus described a further cupboard arrangement which provides a number of advantageous features. This arrangement provides considerable storage capacity in a corner location which otherwise can prove to have little storage capacity. The arrangement provides a neat appearance and can be totally closed away when not required.

Figure 12:
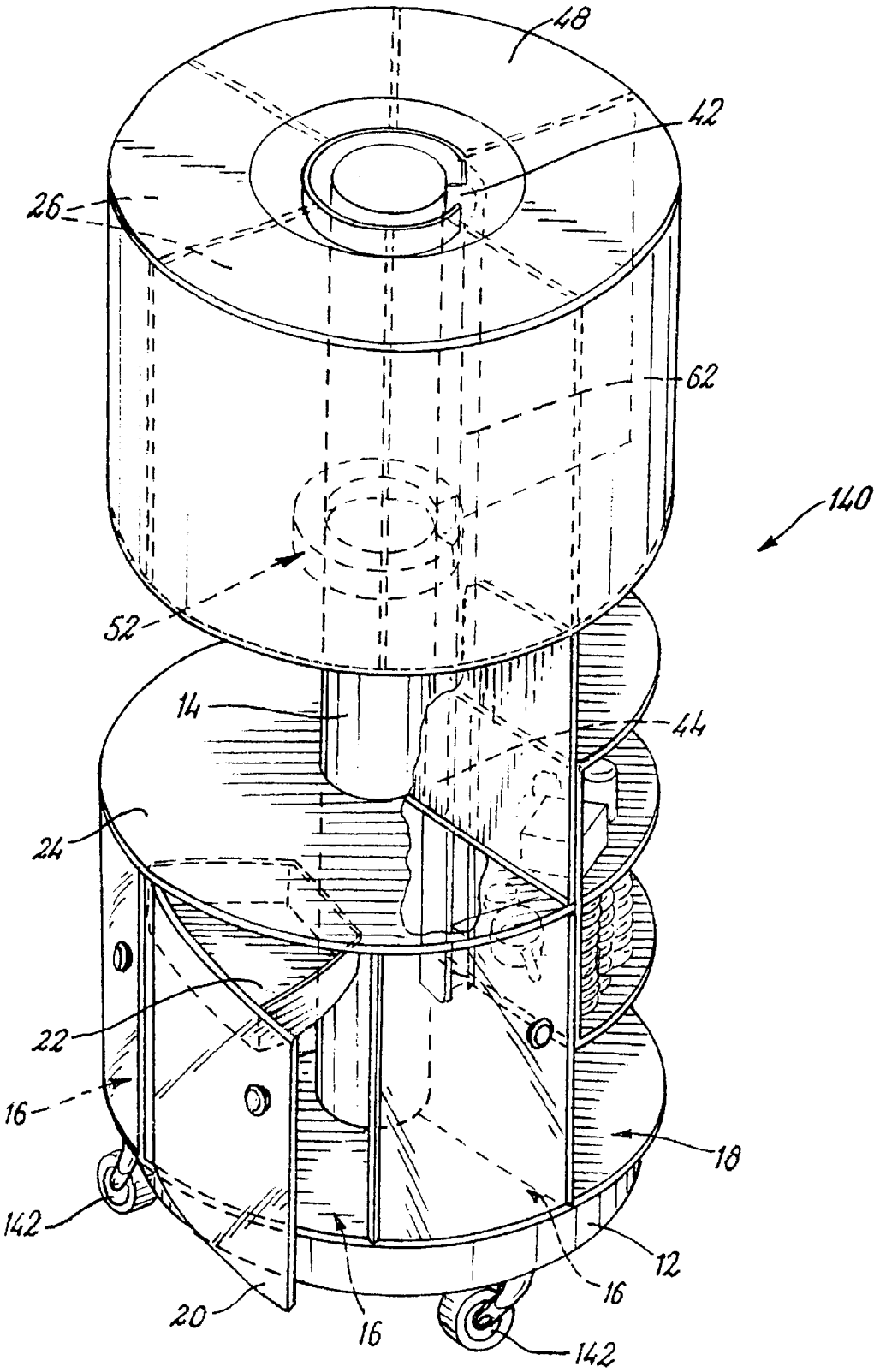
FIG. 12 is a similar view to FIG. 1 of a third storage apparatus according to the invention.

FIG. 12 shows a still further storage arrangement 140. The storage arrangement 140 is identical to the storage arrangement 10 except that the arrangement 140 has ground engaging wheels. The ground engaging wheels are in the form of four equispaced castors 142. The castors 142 permit the arrangement 140 to be readily moved to a required location. Such an arrangement 140 is particularly suitable for storing tools or other components as may be required in a workshop or the like. It is to be realised that a different number of wheels may be provided, as is required for particular circumstances.

Various other modifications may be made without departing from the scope of the invention. For example a different number of cupboards and/or different shaped cupboards could be provided. Different means could be provided for rotating the cupboards and/or lifting them. Means may be provided to identify the different cupboards. Such means could be in the form of fingers which extend outside the cover, and may also act as guides.

The cupboards may have a wide range of different internal arrangements and for example drawers need not be provided on the doors of the lower cupboards as shown in the first described above embodiment. Any of the above features can be combined. For instance, an arrangement of the first described type may have similar lower and upper cupboards such that an originally upper cupboard can be brought down and an originally lower cupboard raised up.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A storage apparatus comprising:

a) a frame arrangement;

b) a plurality of storage compartments rotatably mounted on the frame for rotation about a substantially vertical axis;

c) the apparatus being arranged such that a selected one of the compartments can be moved along said axis to bring said compartment to an accessible height; and, d) the apparatus being arranged such that the components are locatable in raised rest positions, and;

e) the selected one of the components being adapted to be lowered from the rest position axially to an accessible height.

2. A storage apparatus comprising:

a) a frame arrangement;

b) a plurality of storage compartments rotatably mounted on the frame for rotation about a substantially vertical axis;

c) the apparatus being arranged such that a selected one of the compartments can be lowered along said axis to bring said selected compartment to an accessible height;

d) the apparatus further including lower compartments defining a space to receive at least a portion of the selected compartment when fully lowered; and, e) the space being defined between adjacent lower compartments.

3. A storage apparatus (10,80) according to claim 2 wherein, the upper compartments are locatable in a raised rest position, and the selected compartment can be lowered to a lower accessible height.

4. A storage apparatus according to claim 2, characterised in that each lower compartment is rotatably mounted on the frame.

5. A storage apparatus according to claim 2, characterised in that a top of the lower compartments provides a work surface.

6. A storage apparatus according to claim 2, characterised in that the top of the upper compartments when fully lowered provides a work surface.

7. A storage apparatus according to claim 2 characterised in that ground engaging wheels are provided on the frame arrangement to permit ready movement of the apparatus.

8. A storage apparatus comprising:

a) a frame arrangement;

b) a plurality of upper storage compartments, rotatably mounted on the frame for rotation about a substantially vertical axis;

c) the apparatus being arranged such that a selected one of the upper compartments can be moved along said axis to bring said selected compartment to an accessible height; and, d) a single lower compartment extending wholly around the vertical axis except for a segment which defines a space which may receive the selected compartment.

9. A storage apparatus comprising:

a) a frame arrangement;

b) a plurality of upper storage compartments, rotatably mounted on the frame for rotation about a substantially vertical axis;

c) the apparatus being arranged such that a selected one of the upper compartments can be lowered along said axis to bring said selected compartment to an accessible height; and, d) at least one lower compartment is being interchangeable with an upper compartment such that a said at least one lower compartment is movable to a raised rest position.

10. A storage apparatus comprising:

a) a frame arrangement;

b) a plurality of upper storage compartments, rotatably mounted on the frame for rotation about a substantially vertical axis;

c) the apparatus being arranged such that a selected one of the upper compartment can be lowered along said axis to bring said selected compartment to an accessible height;

d) the apparatus being arranged such that the selected compartment can only be lowered when in a particular circumferential position on the axis; and, e) an upper ring positioned around the axis to rotatably support the upper compartments.

11. A storage apparatus according to claim 10, characterised in that the ring includes a gap corresponding to said particular circumferential position.

12. A storage apparatus according to claim 11, characterised in that a lift member is provided which is locatable in the gap to support the selected compartment to be lowered, and is selectively vertically movable.

13. A storage apparatus according to claim 12, characterised in that the lift member is arranged to substantially close the ring when said member is in an upper position.

14. A storage apparatus according to claim 12, characterised in that a support bracket is provided on each storage compartment, said brackets being slidably engageable with the ring and lift member.

15. A storage apparatus according to claim 10, characterised in that a lower ring is provided to rotatably support a lower compartment.

16. A storage apparatus according to claim 15, characterised in that a gap is provided in the lower ring to correspond to the particular position.

17. A storage apparatus according to claim 10 characterised in that the apparatus includes a central shaft which mounts the upper ring, around the shaft with a radial space to receive the upper compartments.

18. A storage apparatus according to claim 17, characterised in that lower compartments are arranged around the shaft with a radial space to receive the upper compartments.

19. A storage apparatus according to claim 17, characterised in that a driveable wheel extends through a wall of the shaft to engage with the compartments.

20. A storage apparatus according to claim 19, characterised in that a motor is provided for driving the wheel.

21. A storage apparatus according to claim 20, characterised in that a plurality of wheels is provided which are connected to the motor.

22. A storage apparatus comprising:

a) a frame arrangement;

b) a plurality of upper storage compartments rotatably mounted on the frame for rotation about a substantially vertical axis;

c) the apparatus being arranged such that a selected one of the upper compartments can be moved along said axis to bring said compartment to a accessible height; and, d) an open bottomed cover is provided and extendible over the upper compartments.

23. A storage apparatus according to claim 22, wherein the cover extends over substantially all of the apparatus.

24. A storage apparatus according to claim 23, characterised in that the cover includes at least one openable part, to provide access to the apparatus.

25. A storage apparatus according to claim 24, characterised in that there are a plurality of openable parts which are doors.

26. A storage apparatus according to claim 24, characterised in that control means are provided and are only accessible when said at least one openable part is open.

27. A storage apparatus according to claim 23, characterised in that the apparatus is arranged such that when the cover is fully closed the apparatus moves to a particular orientation if not already in said orientation.

28. A storage apparatus according to claim 24, characterised in that the orientation comprises all of the upper compartments are in a raised rest position.

* * * * *